United States Patent [19]

von Ohain et al.

[11] 4,321,006

[45] Mar. 23, 1982

[54] GAS COMPRESSION CYCLE AND APPARATUS THEREFOR

[76] Inventors: Hans J. P. von Ohain, 5598 Folkestone Dr., Dayton, Ohio 45459; Frank L. Wattendorf, 3005 P St., NW., Washington, D.C. 20007; Maurice O. Lawson, 7006 Cedar Pines Ct., Dayton, Ohio 45459

[21] Appl. No.: 127,491

[22] Filed: Mar. 5, 1980

[51] Int. Cl.[3] ..... F04B 39/06

[52] U.S. Cl. ..... 415/115; 415/116; 415/168; 415/177; 415/1

[58] Field of Search ..... 415/1, 115, 116, 117, 415/177, 168; 62/115; 165/104.15, 104.18

[56] References Cited

U.S. PATENT DOCUMENTS

| | | | |
|---|---|---|---|
| 2,291,138 | 7/1942 | Blom | 415/168 X |
| 2,549,818 | 4/1951 | Kane | 415/116 |
| 2,680,692 | 6/1954 | Robinson | 165/104.15 |
| 2,806,355 | 9/1957 | Schörner | 416/97 X |
| 3,379,011 | 4/1968 | von Ohain et al. | 60/259 |
| 3,535,850 | 10/1970 | von Ohain et al. | 55/261 |
| 3,549,295 | 12/1970 | Galocsy et al. | 165/104.15 |
| 3,650,636 | 3/1972 | Eskeli | 417/78 |
| 3,719,434 | 3/1973 | Eskeli | 417/78 |
| 3,729,930 | 5/1973 | Williams | 60/39.58 |
| 3,748,057 | 7/1973 | Eskeli | 415/116 |
| 3,828,929 | 8/1974 | Hickey, Jr. | 415/1 X |
| 4,027,993 | 6/1977 | Wolff | 415/1 |

*Primary Examiner*—Leonard E. Smith
*Attorney, Agent, or Firm*—Raymond J. Crowley

[57] ABSTRACT

A centrifugal compressor is provided with means to centrifugally accelerate a gas stream and to simultaneously centrifugally accelerate a stream of dense small solid particles and discharging both streams into a vane free radial diffuser to form a composite flow in which kinetic energy from the particles is absorbed by the gas molecules while the heat of compression of the gas is absorbed by the solid particles, the composite flow then entering a centrifugal particle separator to give a clean high pressure gas for subsequent utilization.

8 Claims, 9 Drawing Figures

CLEAN AIR DISCHARGE
DIRECTION OF ROTATION
COOLANT
TO 42

R2
R1
θ
102
103
105
106
107
108
116
117
118
142
145
146
148
150
152
153
154
155
174
175
176
178
179
180
181
182
183
184
185
186

GAS COMPRESSION CYCLE AND APPARATUS THEREFOR

BRIEF SUMMARY

Great difficulties have been encountered in trying to adapt gas turbine drives to automobiles and trucks because of low overall efficiency and cost limitations preventing use of multistage compressors. Attaining pressure ratios in excess of four to one in a single stage centrifugal or mixed flow compressor is impractical because of excessive temperature rise and flow instability.

In accordance with the invention a compressor system is provided which substantially alleviates the problems encountered in the prior art. This is accomplished by providing a conventional vaned centrifugal compressor rotor, either single or double sided, and housed to provide a gas inlet and an outlet from the rotor vane passages. Means are provided for admitting a dense material in the form of solid small particles under sufficient pressure to flow at a controlled rate into the rotor vane gas flow passages or into separate radial passages formed in the rotor. The dense particles flow along the pressure faces of the rotor vanes or in the separate rotor radial passages and remain segregated from the gas flow until both pass into the inlet of a vane free radial diffuser. In the entrance of the diffuser the gas and particle streams intimately mix to form a composite flow in which the gas molecules absorb kinetic energy from the dense particles while the latter absorb heat of compression from the gas molecules so that the compression cycle is substantially isothermal. With a radial diffuser having an outlet radius equal to four or more times the inlet radius, pressure ratios at the outlet may be obtained in the order of ten to twenty to one with substantially ninety percent or more of the kinetic energy of the dense particles transferred to the gas stream. Pressure ratios obtained can be controlled by regulation of the quantity of particulate matter allowed to flow per unit of time. The composite flow discharge from the radial diffuser is passed into a centrifugal particle separator where the high pressure gas is separated from the particles and available for end use in a gas turbine, refrigeration cycle or the like with the separated particles being subsequently cooled and returned for recycling.

REFERENCE TO PRIOR ART

We are aware of the following U.S. letters patent which have some pertinence in the field of the invention: U.S. Pat. Nos. 2,549,818; 3,379,011; 3,729,930; 3,748,057 and 4,027,993.

DESCRIPTION OF THE DRAWINGS

For a more complete understanding of the invention reference should be made to the detailed description taken in conjunction with the appended drawings in which.

DETAILED DESCRIPTION

Figures 1, 2, 3:
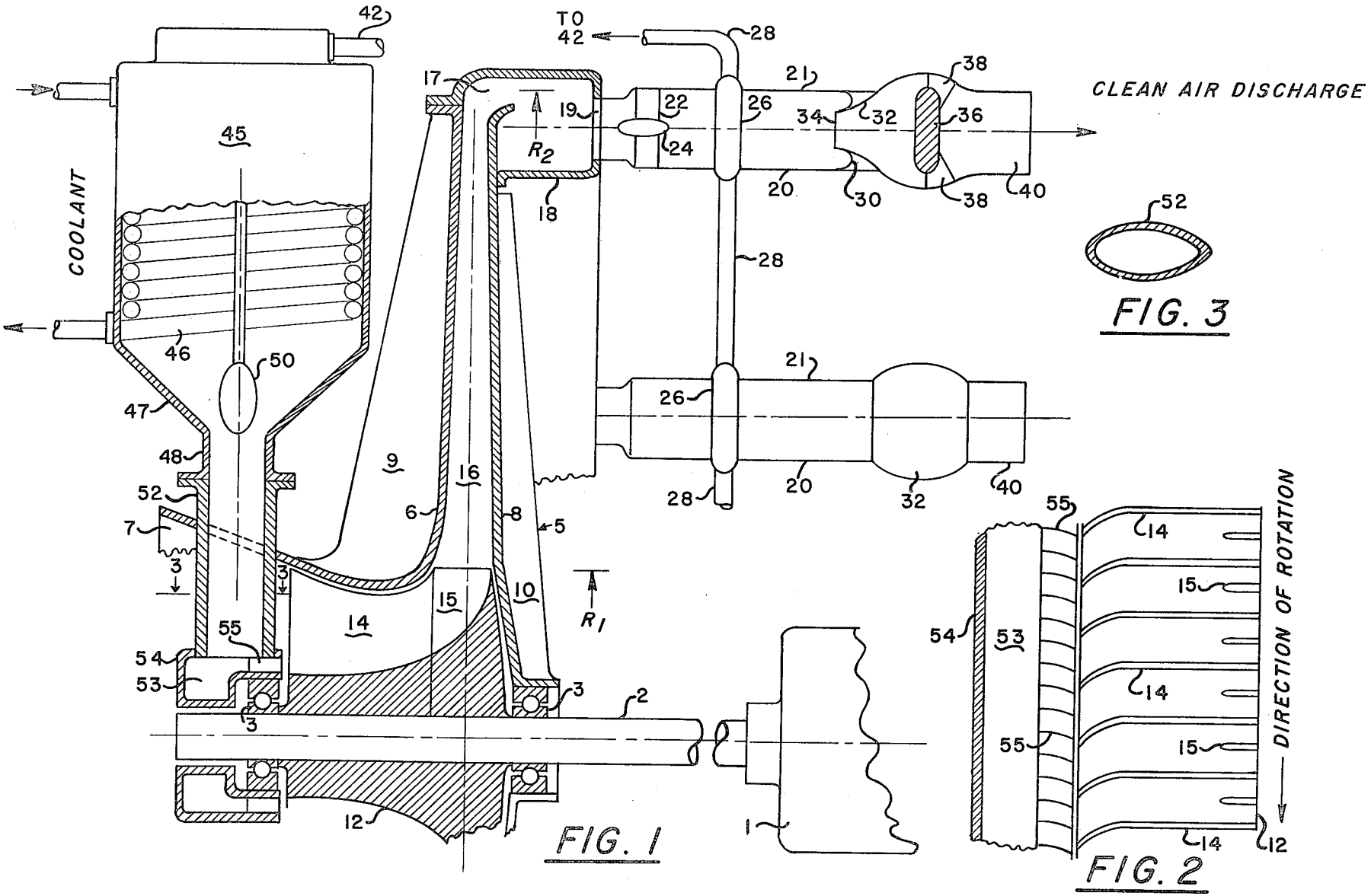
FIG. 1 is a side elevation partly in section illustrating a gas compression system in accordance with the invention.
FIG. 2 is a flat developed view partially illustrating the rotor vane and particulate dispensing structure.
FIG. 3 is a cross sectional view taken on line 3—3 of FIG. 1 streamlined particulate feed conduit.

Referring now to FIG. 1, the reference numeral 1 generally indicates a power source such as an electric motor adapted to drive a shaft 2 journalled in bearings 3 and constituting the drive means for a centrifugal compressor generally indicated by the reference numeral 5. The compressor 5 is divided on the vertical centerline into front housing 6 and a rear housing 8, the upper half of the housings and other compressor structure only being shown. The housing 6 is provided with a bell mouth air inlet 7. The housings are stiffened by a plurality of webs 9 and 10 respectively equally angularly disposed about the horizontal centerline. The housings 6 and 8 enclose a rotor hub 12 rigidly secured to and rotatable with the shaft 2. The rotor hub 12 has secured thereto radial vanes 14 with the entrance portions deflected forward as seen in FIG. 2, to provide a shock free entrance for air received from the inlet 7. The rotor vanes 14 are equally angularly disposed about the horizontal centerline and may number for example 18 vanes with straight radial vanes 15 for example nine in number each disposed between pairs of adjacent vanes 14 (note FIG. 2).

The housing elements 6 and 8 together form a radially extending diffuser passage 16 connected at one end to the radial flow passages between the rotor vanes 14 and 15 and at its outer end by means of an annular port 17 into a hollow annular collecting ring 18 which may be if desired in the form of a scroll. The radius $R_2$ of the outlet of the diffuser 16 is equal to or greater than four times $R_1$ the radius of the outlet of the compressor rotor vanes 14 and 15. The collector ring 18 as seen in FIG. 1 is provided with a plurality of ports 19 each adapted to be connected to the interior of a particulate separator generally indicated by the reference numeral 20. The separator 20 is of the type disclosed in U.S. Pat. No. 3,535,850 and is a modified form of the separator shown in FIG. 5 of the patent. The separator 20 comprises a cylindrical casing 21 shown in section, and forming a vortex chamber connected at its forward end to the port 19 and is provided with a plurality of radial swirl vanes 22 and with a central streamline body 24 which serves as an anchor for one end of the spin axis of the vortex flow initiated in the housing 21 by the swirl vanes 22. The housing 21 is provided downstream from the swirl vanes 22 with a circumferential groove 26 which collects particulate matter centrifuged outward by the vortex flow and is connected to a discharge conduit 28. The vortex chamber formed by the casing 21 is provided near its outer end with a cusp shaped guide surface 30 surrounding a conical diffuser 32 having a central inlet 34. The diffuser 32 is provided with a wall member 36 which serves as an anchor for the outer end of the vortex spin axis. The diffuser 32 includes radial diffuser vanes 38 which remove the residual spin of the flow and discharges the same to a cylindrical chamber 40 from which clean high pressure air is discharged for utilization in a gas turbine, refrigeration equipment or in closed cycle gas pumping systems.

The centrifugal particle separators 20 connected to ports 19, FIG. 1, may number 6 equally angularly disposed about the axis of shaft 2, two only being shown in FIG. 1, the upper one in section as noted. The collector grooves 26 from each separator are connected in series to discharge conduit 28, see FIGS. 6B and 6C, U.S. Pat. No. 3,535,850 previously referenced. The vortex swirl direction in adjacent separators 20 are in opposite directions so as to have the direction of flow in the connected sections of conduit 28 in the same direction, in the manner shown in FIGS. 6B and 6C of the patent.

Referring again to FIG. 1, the terminal end of the separated particle conduit 28 connects to a conduit 42 which returns the total particles collected from the separators 20 to the upper end of a reservoir generally indicated by reference numeral 45. The container 45 is provided with an internal cooling coil 46 adapted to circulate a cooling medium from an external source (not shown) to remove heat from the particulate matter returned to container 45. The container 45 has a tapered bottom portion 47 terminating in a discharge conduit 48, flow through which is adapted to be controlled by a valve member 50 actuated by servo or other means to regulate the flow of particulate matter into the compressor. The discharge conduit 48 connects to a feed conduit 52, which in the portion within the compressor inlet bell 7, is preferably of hollow streamline cross section (note FIG. 3). The feed conduit 52 connects to the hollow interior chamber 53 of an annular casing ring 54. The chamber 53 is provided with an annular portion fitted with discharge vanes 55 of airfoil shape and curved (see FIG. 2) to direct the discharge of particulate material in the direction of rotation of the compressor rotor vanes 14 so as to minimize entry shock.

The operation of the device disclosed in FIGS. 1 through 3 is as follows: The particulate container 45 is filled with the requisite amount of material which may be spherical particles of carbon, titanium, titanium aluminate or the like with dimensions of the order of from one to ten microns. When the electric motor or other power source 1 is energized shaft 2 of compressor 5 is rotated at high speed driving the rotor hub 12 and vanes 14 and 15 which will draw air or other gas into the inlet bell 7 where it will contact the curved entrance portions of vanes 14 (note FIG. 2) and impelled into the flow passages between the vanes 14 and radial vanes 15. The air accelerated in the vane flow passages will be discharged at high velocity into the entrance of the radial diffuser passage 16. Simultaneously particulate material in the container 45 will flow at a controlled rate past valve element 50 into conduits 48 and 52 into the annular chamber 53 of the casing element 54. The particulate material emerges from the flow spaces between vanes 55 (note FIG. 2) and is directed into the flow spaces between the rotor vanes. The particles will immediately flow into contact with the pressure faces of the rotor vanes and will remain segregated from the adjacent air flowing in the vane passages. The particulate matter will be discharged from the rotor vane passages with a high radial and circumferential velocity into the entrance of the diffuser 16. There the fine particles will mix with the entering compressed air or other gas stream and proceed radially outward in the diffuser page 16 as a composite flow. The air stream component of the composite flow will by viscous friction absorb kinetic energy from the particles so that by the time the composite flow reaches the exit of the radial diffuser 16, a large portion, such as ninety-five percent, of the kinetic energy of the particles will have been transferred to the gas molecules. Further, the particulate matter or particles will absorb the heat generated in compression of the gas so that the cycle will be substantially isothermal. The composite flow will be discharged and from the diffuser passage 16 under high pressure and pass through the annular port 17 into the collector ring 18 and thence through ports 19 into the separators 20, six or more in number, two only being shown in FIG. 1. Upon entering the separator housing 21, the composite flow will meet the swirl vanes 22 which will initiate a vortex flow which will have its spin axis anchored on the rear of the streamline body 24 and the stationary wall member 36. Due to intense rotation at the core of the vortex flow the particulate matter will be separated out by centrifugal force and will travel along the chamber walls to be collected in the annular groove 26 to ultimately be discharged into conduit sections 28 and returned under pressure via conduit 42 to reservoir 45 for cooling and recirculation. In the vortex chamber 21 flow proceeding downstream in part is redirected by the cusp like wall member 30 to carry particulate matter back to the collector groove 26. Clean air with all particles removed passes by port 34 into a radial diffuser chamber 32 with further rotation removed by diffuser vanes 38 and flowing as clean gas under high pressure through discharge chamber 40 for ultimate use in a gas turbine, refrigeration cycle or the like. The theory of centrifugal particle separators of the type above described is more fully disclosed in U.S. Pat. No. 3,535,850 previously referenced.

Figure 4:
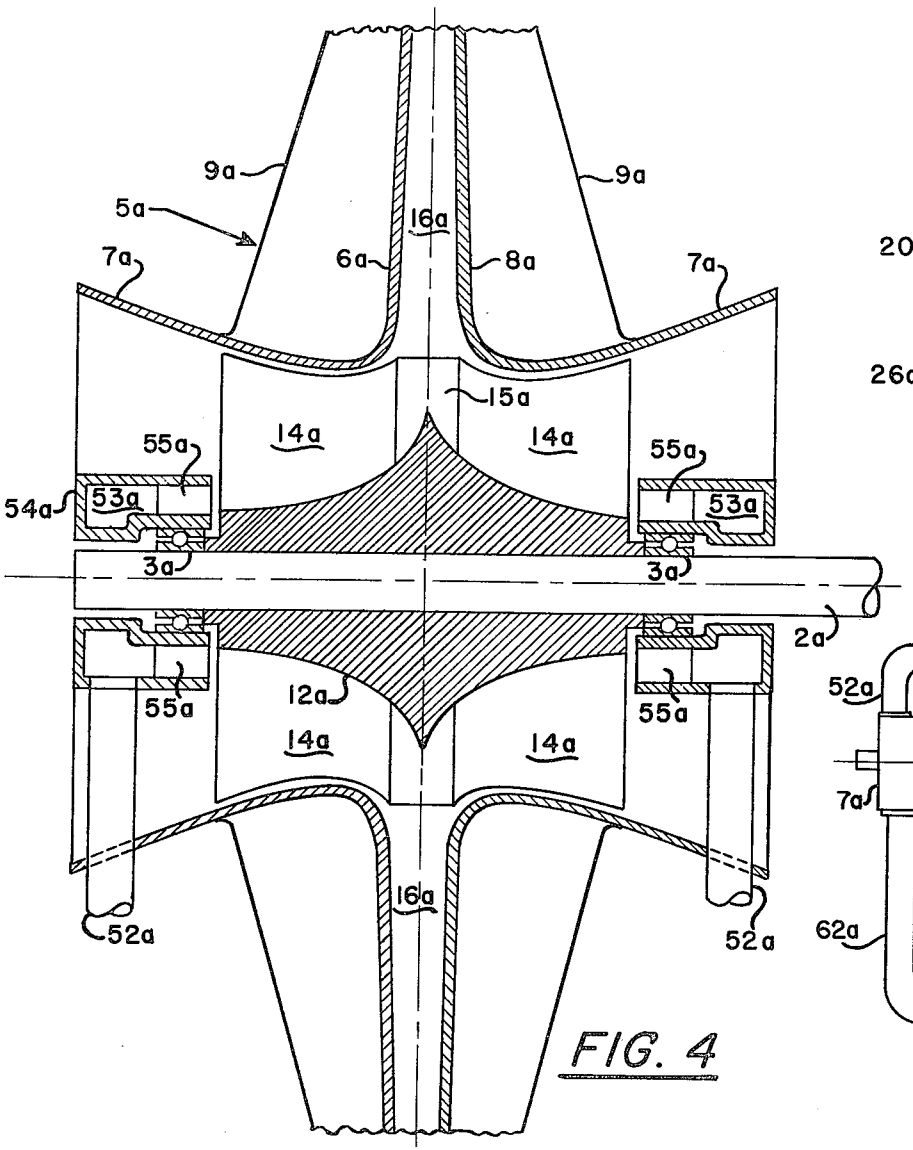
FIG. 4 is a partial vertical sectional view illustrating the invention applied to a double sided centrifugal compressor rotor.

With reference to FIG. 4 there is shown a centrifugal compressor similar in operation to that of FIG. 1 and differing only in employing a double entry impeller. In this figure parts corresponding to FIG. 1 are indicated by the same reference numeral with the subscript a. The compressor 5*a* is symmetrical about both horizontal and vertical centerlines and includes driving shaft 2*a* supported by journal bearings 3*a*. The front and rear housings 6*a* and 8*a* are identical and enclose radial and annular diffuser chamber or passage 16*a*. The housings are provided with identical bell mouth air inlets 7*a*. The compressor rotor hub 12*a* has mounted thereon pairs of vanes 14*a* having curved inlet portions as in FIG. 2 abutting at the vertical centerline to form a continuous vane and with radial intermediate vanes 15*a* positioned between adjacent pairs of vanes 14*a* at each end of the rotor 12*a* is an annular housing 54*a* with an interior chamber 53*a* adapted to be connected by conduits 52*a* to a single particulate chamber such as 45, FIG. 1. The chambers 53*a* are provided with sets of vanes 55*a* adapted to direct controlled streams of dense small particles into the space between vanes 14*a* in the same manner as in the device of FIG. 1.

In operation the rotor blades draw in air or other gas through the inlet bells 7*a* into the inlet portions of the compressor vanes 14*a* and together with radial vanes 15*a* deliver merging air streams into the inlet of the vane free diffuser passage 16*a*. Similar to the action in FIG. 1, particulate matter in the chambers 53*a* is dispensed by the director vanes 55*a* into the spaces between adjacent rotor vanes 14*a*. The dense particles will rest against the pressure faces of vanes 14*a* and 15*a* while being centrifugally impelled toward the rotor vane outlets and into the entrance of the radial vane free diffuser 16*a* where the flow becomes a composite flow which proceeds toward the diffuser outlet in the same manner as in the device of FIG. 1. The principal advantage of the double ended compressor 5*a* of FIG. 4 is that lower frictional losses in the double entry compressor makes it more suitable for use in a gas turbine power plant.

Figure 5:
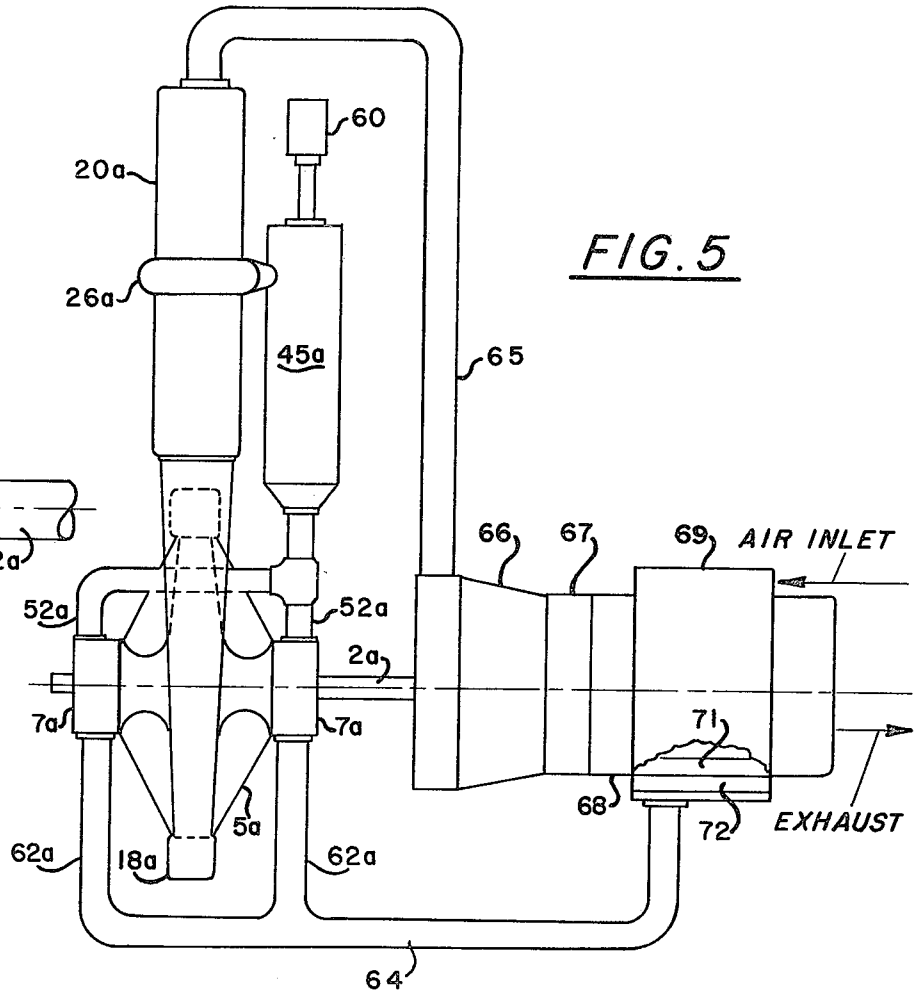
FIG. 5 is a schematic view of a gas turbine power plant utilizing a compressor such as illustrated in FIG. 4.

The use of a compressor in accordance with the invention in a gas turbine power plant is illustrated in FIG. 5. In this figure a double sided compressor 5*a* of the type disclosed in FIG. 4, is employed with a scroll type collector ring 18*a* delivering the compressed composite flow from the compressor 5*a* to a single large particle separator 20*a* of the same type as in FIG. 1. The separated particulate matter is collected in an annular groove 26*a* and delivered by a conduit 28*a* to particle storage container 45*a* whose rate of discharge can be controlled by a servo valve actuator 60 in a known manner. The inlet housings 7*a* of the compressor 5*a* are each connected to an air supply conduit 62*a* which in turn are connected in parallel to a conduit 64.

The output of clean compressed air discharged from the separator 20*a* is led by a conduit 65 to the combustion chamber 66 of a gas turbine power plant generally indicated by the reference numeral 70 and which also includes a turbine section 67 which drives compressor shaft 2*a*, an exhaust section 68 which has a recuperating heat exchanger 69 in conjunction therewith. The heat exchanger 69 has vanes 71 in contact with the exhaust gases with portions 72 adapted to conduct heat to the inlet air flowing into the heat exchanger and passing out to the compressor 5*a* via the conduit 64 connected at its outer end to the heat exchanger 69. In this power plant the high pressure ratios obtainable in the diffuser 20*a*, because of the interchange of energy between the air flow and the particle flow therein, makes it possible to have a high efficiency and still only employ a conventional heat exchanger as a recuperator.

Figures 6, 7, 8, 9:
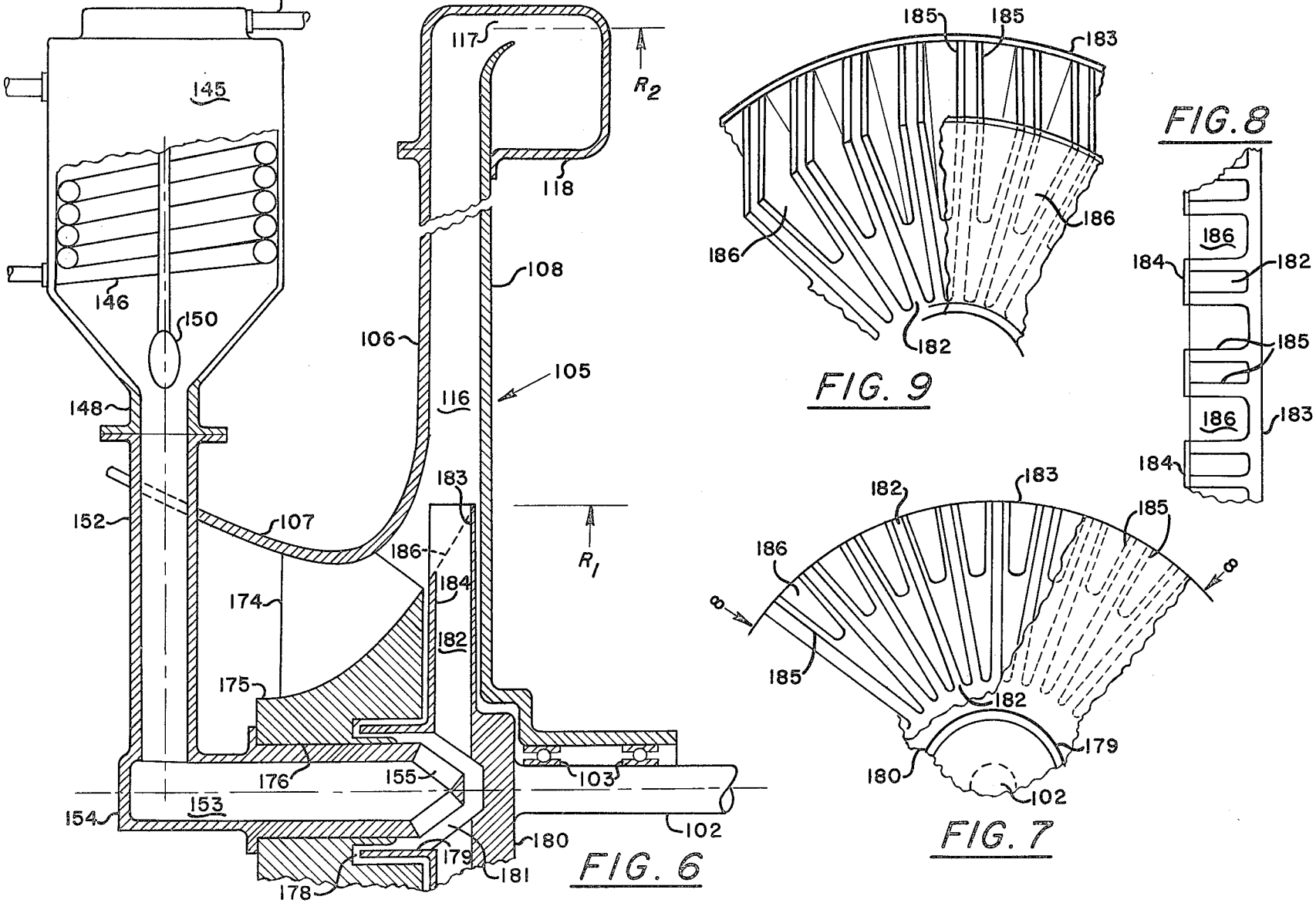
FIG. 6 is a fragmentary sectional view of a modified form of the compressor of FIG. 1 ensuring complete segregation of the particles from the gas streams during centrifugal acceleration in the rotor.
FIG. 7 is a fragmentary front elevation of the compressor rotor of FIG. 6.
FIG. 8 is a developed top plan view of the rotor of FIG. 7 taken on line 8—8 of FIG. 7.
FIG. 9 is an isometric sketch further illustrating the compressor rotor of FIGS. 6 through 8.

With reference now to FIG. 6, there is shown a centrifugal compressor similar to that of FIG. 1 except for means to more thoroughly isolating the particle streams when centrifugally accelerated in the compressor rotor. Parts corresponding to FIG. 1 are indicated by the same reference numeral as in FIG. 1 plus one hundred.

As seen in this figure, the compressor generally indicated at 105 has a driving shaft 102 journalled in bearings 103. The compressor has a front housing 106, with bell mouth inlet 107 and a rear housing 108 which together define a radial vane free diffuser passage 116 terminating in an annular outlet passage 117 which discharges into an annular collector ring 118 which may be in the form of a scroll or may be connected laterally to centrifugal separators, not shown, similar to the separators 20 of FIG. 1.

The inlet bell 107 of casing 106 is provided with stationary swirl or prerotation vanes 174 having their outlet portions bent in the direction of rotation of the compressor rotor so as to give a shock free entry to the gas or air stream entering the compressor rotor. The swirl vanes 174 are mounted on a stationary core ring 175 whose outer surface is contoured so as to form together with the inner wall of inlet bell 107 a smooth arcuate flow passage between the adjacent inlet swirl vanes 174. The stationary core ring 175 is provided with a central bore 176 adapted to receive the solid particle dispensing means which includes a tubular casing 154 which extends into the bore 176. The casing 154 has a hollow interior 153 communicating with the spaces between the vanes 155 which are adapted to be deflected to distribute particle flow therethrough with a swirl in the same direction of rotation as the centrifugal rotor, as in FIG. 1. The particles dispensing passage 153 is supplied with particles under pressure from a conduit 152, conduit 148 and particle reservoir 145 provided with particle cooling coil 146, and control valve 150 with particle return conduit 142 all intended to function in the same manner as in the device of FIG. 1. The stationary core ring 175 is provided with a longitudinally extending narrow annular slot 178 intended to serve as a labyrinth seal in conjunction with a hollow cylindrical projection 179 of the compressor rotor hub structure 180. The rotor is made from a solid metal cylinder bored out to form the central conical cavity 181. The rotor blank is milled out to form narrow rectangular slots 182 extending radially from the central cavity 181, to the rotor outlet. The slots 182 are closed on their rear sides by a web 183, note FIGS. 7, 8 and 9, formed in milling the slots in the rotor blank. The slots 182 are closed on their front sides by thin metal fingers 184, note FIGS. 6 and 7, secured at their inner ends to the annular ring 178, the fingers and ring being brazed or otherwise bonded to the rotor body. The radial rotor slots 182 may be equangularly spaced about the rotor periphery for example every 10° or a total of thirty-six slots. The rotor vanes 185 are formed by milling arcuate wedge shaped cavities 186 between the slots 182 leaving thin webs 185 on each side to in part define part of the walls of the slots 182. The rotor vanes each are formed by a pair of thin webs 185, the slot 182 and slot closure strip 184. The rotor vane passages are formed by the milled out cavities 186, note FIG. 9. The cavities 186 are open on their front side and adapted to receive air drawn in through inlet bell mouth 107, past the stationary prerotation vanes 174 into the rotor vane passages, cavities 186 and impacted by the vanes 185 forming the side walls of the cavities 186. Air entering the cavities 186 is centrifuged radially outward and discharged into the entrance of the radial vane free diffuser passage 116.

At the same time cooled particles are driven by pressure from the particle reservoir 145 past valve 150 into conduits 148 and 152 into chamber 153 and discharged from the spaces between the vanes 155 where the particle streams are given a whirl in the direction of rotation of the compressor rotor 180 to attain shock free entrance. The flow from the vanes enters the conical bore 181 of the rotor 180 and directly passes into the radial passages 182 in direct communication therewith. The particles entering the rectangular vane passages or slots 182 are centrifuged radially outward and discharged with high velocity between adjacent streams of air or gas from the cavities 186. Because the slots or passages 182 extend substantially over the full width of the rotor 180 a more even discharge of the particles into the inlet of the diffuser is achieved. The alternate streams of air or gas, and particles entering the diffuser 116 form a more uniform composite flow than in the device of FIG. 1 and a more complete transfer of kinetic energy from the particles to the gas and heat from the gas to the particles is achieved. To achieve good results it is essential that the exit radius $R_2$ of the diffuser 116 be at least four or more times the exit radius $R_1$ of the compressor 105.

The discharge of the composite flow from the diffuser 116 outlet port 117 into the collector ring 118 is the same as in the previous forms of the invention. Though not shown, it is contemplated that centrifugal particle separators such as 20 of FIG. 1 will be employed to separate the particles from the high pressure gas stream. The particles separated will be returned via conduit 142 to reservoir 145 for cooling and recirculation as in the device of FIG. 1.

Having now described our invention we claim:

1. In a gas compression system a centrifugal compressor having a vaned rotor therein adapted to centrifugally accelerate a gas stream therein and to discharge the gas stream therefrom, means in said rotor for centrifugally accelerating a stream of dense small particles and discharging the same to comingle with the gas stream, a radial vane free diffuser having an inlet and an outlet with the inlet adapted to receive the gas and particle streams to form a composite flow for kinetic energy transfer from the particles to the gas stream and heat energy from the gas stream to the particles and means connected to the outlet of the diffuser for separating the particles from the composite flow to leave a clean high pressure gas stream.

2. In a gas compression system a centrifugal compressor having a gas inlet, a vaned rotor communicating with the said inlet, a gas outlet from said rotor, said rotor vanes centrifugally accelerating gas from said inlet to said outlet, means for admitting a continuous stream of dense solid particles of the order of one to ten microns in size for acceleration in said rotor, a radial vane free diffuser having an inlet and an outlet, said diffuser inlet adapted to receive the gas and particle flows from said rotor to form a composite flow in said diffuser, the gas molecules absorbing kinetic energy from said solid particles to increase the energy content of the gas and the solid particles absorbing the heat of compression from said gas molecules during the transit of said composite flow through said diffuser to the outlet thereof, means for receiving the composite output flow from said diffuser and centrifugally separating the solid particles from the high pressure gas stream, means for cooling the separated solid particles and collecting the same for recirculation.

3. In a gas compression system of the character described, a centrifugal compressor having a casing enclosing a rotor, a shaft for driving the rotor, at least one gas inlet in the casing, vanes mounted on said rotor and having radial portions thereon, the passage space between the vanes communicating with said casing gas inlet, a storage chamber for containing solid particulate matter with the particles thereof being of the order of one to ten microns in diameter, means for injecting the particulate matter into the flow space between the rotor vanes into contact with the pressure faces of said vanes and to be centrifugally impelled outward segregated from the gas flow simultaneously being accelerated in the vane flow passages, a vane free radial diffuser chamber in said compressor housing having an inlet adapted to receive the mixed flow discharge from the rotor vane passages and the gas molecules absorbing kinetic energy from the particle component in the composite flow, a discharge outlet from said diffuser, a hollow collector ring communicating with said outlet and particle separating means connected to said collector ring including means for returning the separated particles under pressure to said solid particle storage means, said particle separating means having discharge means for discharging high pressure clean gas therefrom.

4. The structure as claimed in claim 3, in which the vane free diffuser has a discharge outlet radius equal to or greater than four times the outlet radius of the flow passages of said rotor vanes.

5. The structure as claimed in claim 4, in which the particle separating means comprises a casing forming a vortex chamber, swirl vanes at the entrance to said vortex chamber, a circumferential groove in said casing adapted to collect particles centrifuged outward from vortex flow in said vortex chamber, a conduit for discharging separated particles from said collecting groove, a stationary member adjacent said swirl vanes for anchoring one end of the axis of said vortex flow, a diffuser downstream from the collector groove having an inlet on the vortex spin axis and having a stationary wall member therein adapted to anchor the outer end of the vortex spin axis, and a conduit for receiving the high pressure clean gas discharge from the diffuser.

6. In a gas compression system, means for forming a flowing gas stream, means for forming a volumetrically regulated flow stream of solid dense particles of the order of from one to ten microns in diameter, means for simultaneously centrifugally accelerating each of said streams to a high circumferential and radial velocity, means forming a vane free radial diffuser having an inlet and an outlet, said diffuser inlet being adapted to receive each of said accelerated flow streams for mixing in said diffuser to form a composite flow, the vane free radial diffuser having an outlet radius equal to or greater than four times the diffuser inlet radius so that the gas molecules can absorb a major amount of the kinetic energy of the particles for increasing the ultimate pressure recovery in the gas stream, said particles absorbing heat from the gas molecules, means connected to the outlet of the diffuser for centrifugally separating the solid particles from the composite flow to leave a stream of clean high pressure gas.

7. The structure as claimed in claim 6, in which the means for accelerating said two named flow streams is a vaned centrifugal rotor.

8. The structure as claimed in claim 7, in which the means for accelerating the gas and particle streams is a vaned centrifugal rotor having an inlet and an outlet with flow passages for the gas stream extending from said inlet to said outlet, said rotor having separate radial passages for receiving and accelerating said particle stream out of contact with said gas stream, said last named radial passages adapted to discharge said particle streams for intermixing with said gas stream, a radial diffuser having an inlet and an outlet the inlet being adapted to receive both the gas and particle streams from the rotor said streams forming a composite flow in the diffuser with the gas stream absorbing kinetic energy from the solid particle stream and the solid particles absorbing the heat of compression from the gas stream, means connected to the outlet of said diffuser for collecting the said composite flow and separating the particles therefrom.

* * * * *